US011412816B2

(12) United States Patent
Singleton

(10) Patent No.: US 11,412,816 B2
(45) Date of Patent: Aug. 16, 2022

(54) INSOLE PIVOT SYSTEM FOR FOOTWEAR

(71) Applicant: Angela Singleton, Annapolis, MD (US)

(72) Inventor: Angela Singleton, Annapolis, MD (US)

( * ) Notice: Subject to any disclaimer, the term of this patent is extended or adjusted under 35 U.S.C. 154(b) by 275 days.

(21) Appl. No.: 16/791,653

(22) Filed: Feb. 14, 2020

(65) Prior Publication Data

US 2020/0178649 A1 Jun. 11, 2020

Related U.S. Application Data

(63) Continuation of application No. 12/749,223, filed on Mar. 29, 2010, now abandoned, which is a continuation of application No. PCT/US2008/004926, filed on Apr. 16, 2008.

(60) Provisional application No. 61/023,621, filed on Jan. 25, 2008, provisional application No. 60/976,024, filed on Sep. 28, 2007.

(51) Int. Cl.

| | |
|---|---|
| ***A43B 17/02*** | (2006.01) |
| ***A43B 13/40*** | (2006.01) |
| ***A43B 7/14*** | (2022.01) |
| ***A43B 7/22*** | (2006.01) |
| ***A43B 21/00*** | (2006.01) |
| ***A43B 7/1405*** | (2022.01) |

(52) U.S. Cl.

CPC ..... *A43B 17/02* (2013.01); *A43B 7/141* (2013.01); *A43B 7/22* (2013.01); *A43B 13/40* (2013.01); *A43B 21/00* (2013.01)

(58) Field of Classification Search

None

See application file for complete search history.

(56) References Cited

U.S. PATENT DOCUMENTS

| | | | | | |
|---|---|---|---|---|---|
| 2,828,555 | A * | 4/1958 | Ledos | A43B 7/143 | 36/176 |
| 2,917,757 | A * | 12/1959 | Scholl | A43B 7/142 | 12/146 M |
| 3,265,071 | A * | 8/1966 | Kirchner | A43B 7/143 | 36/145 |
| 3,306,300 | A * | 2/1967 | Van Kleef | A43B 7/142 | 36/178 |
| 3,470,880 | A * | 10/1969 | Pagliano | A43B 7/1415 | 36/178 |
| 4,084,333 | A * | 4/1978 | Del Vecchio | A43B 3/108 | 36/43 |
| 4,686,993 | A * | 8/1987 | Grumbine | A43B 7/141 | 36/140 |
| 5,577,334 | A * | 11/1996 | Park | A43B 7/145 | 36/28 |
| 2004/0211086 | A1* | 10/2004 | Dananberg | A43B 7/144 | 36/11.5 |

* cited by examiner

*Primary Examiner* — Jila M Mohandesi
(74) *Attorney, Agent, or Firm* — Leveque IP Law, P.C.

(57) ABSTRACT

A shoe, particularly a high-heeled shoe, containing a convex midfoot support structure formed of a cushioning material that is sized and shaped to have a height ($h_1$) sufficient to contact and to support at least a portion of the midfoot area of the wearer's foot. The midfoot support may be constructed of an elastomeric material with a maximum thickness of between 10 mm and 22 mm, and includes a support platform and side walls. Preferably, a forefoot support may also be provided on the upper surface of the insole in the forefoot portion of the insole.

20 Claims, 7 Drawing Sheets

INSOLE PIVOT SYSTEM FOR FOOTWEAR

CROSS-REFERENCE TO RELATED APPLICATIONS

The present application is a continuation of U.S. patent application Ser. No. 12/749,223, filed on Mar. 29, 2010, which is a continuation of International patent application serial no. PCT/US2008/004926, filed on Apr. 16, 2008, which claims priority to U.S. provisional patent application Ser. No. 61/023,621, filed on Jan. 25, 2008, and U.S. provisional patent application Ser. No. 60/976,024 filed on Sep. 28, 2007. All prior applications are herein incorporated by reference.

BACKGROUND

The present invention relates to an insole support system for footwear, with a preferred embodiment intended for use in high-heeled shoes.

The present invention relates generally to footwear, including particularly high heeled footwear typically worn by women as well as lower heeled footwear styles. More particularly, the present invention relates to improvements to footwear to increase comfort and performance.

Conventional high heeled footwear is often uncomfortable, tiring, and even painful to wear and to walk in. There are several medical problems associated with wearing high heels, including foot, ankle, knee, hip, and lower back problems. Yet many women still wear high-heeled footwear regularly because it can make the wearer more stylish, elegant, professional, and/or sexy, and to make the wearer look taller.

The discomfort and pain from wearing high-heeled footwear arises because high-heeled footwear significantly alters the wearer's posture and stance. In a flat shoe or a barefoot condition, the load distribution is approximately 5% over the toe area, 40% over the balls of the foot, 5% over the midfoot, and 50% in the heel areas of the foot. Thus body weight is relatively evenly distributed between the front part and the rear part of the foot.

As the heel height increases, the load weight distribution changes, moving forwardly, and the percentage of body weight carried by the balls of the foot is increased. Generally, for a wearer standing or walking in high heels, the heel bears substantially less pressure than the forefoot. For example, in a high heeled shoe with a two inch heel, in general 70% of the wearer's body weight is borne by the balls of the wearer's foot, and the transient load on the balls of the feet can be as much as 250% of the pressure in the ball of the foot area in a flat shoe. Also, as heel height increases the forefoot contact area between the ball of foot area and the shoe insole reduces in area and moves forwardly near to the toe area.

A substantial percentage of high-heeled shoe wearers report pain associated with the wearing of such footwear within thirty minutes to four hours of typical walking, standing, and sitting found in a work or social environment. In many high-heeled shoes the steep ramp of the shoe causes the foot to slide downwardly, crowding and cramping the toes. In addition, the wearing of high-heeled shoes can contribute to lower back pain, particularly for wearers having weaker abdominal muscles. Without a doubt, high-heeled shoes are uncomfortable to stand in or walk in for long periods of time.

I have developed and tested a number of prototype shoes in accordance with the invention described in this application, and I have concluded that a primary cause for wearer discomfort is the insufficient support of the wearer's midfoot area, and the concentration of load on the wearer's forefoot areas. In particular, in many high heeled shoes, the contour of the footbed does not conform to the wearer's foot, and the wearer's foot does not come into contact with the footbed in the central areas of the shoe. For many wearers, the gap between the foot midfoot area and the footbed is so substantial that there is a visible gap between the wearer's foot and the footbed. Where only the heel and the forefoot come in contact with the shoe there is a substantial loss of foot to footbed contact for proper support.

In one test I developed, measurements on a test subject comparing the subject's feet wearing (1) a flat shoe, with (2) a 100 mm high heel shoe, showed a loss of 5.64 square inches of contact area, or 36.3%, of surface area, for one foot.

In another test I developed, the longitudinal foot profile of 4 separate test subjects, each the same shoe size, at U.S. Women's Size 8.5 was studied. The foot profile in a 100 mm high heel was studied for each subject. It was discovered that a clearance length, by which I mean the length (from heel area to forefoot area) of the gap between the foot midfoot area and the footbed, is about 6 inches, on average. In this test, the 6 inches is about 62% of the 95/8 inch length of the shoe. In other words, about 62% of the foot is suspended in air with no support. Measurements of the test subjects to determine the maximum midfoot height, by which I mean the peak height from the sole surface to the arch of the foot in the midfoot area of the foot, was found to be roughly ½ inch from the footbed, for a person with a normal arch, and up to 1.5 inches, for a person with a high arch.

Most current manufacturers that provide insole comfort features for women's high heels believe that such enhancements need to be very thin to accommodate the sleeker construction of the shoe. As a result, insole padding, cushioning systems, and inserts are often thinner than standard insoles for flat shoes, averaging about 2 mm to 3 mm, on average, in a shoe without a special platform construction. However, high heels should instead actually require thicker systems than their flat counterparts if the foot is to come in contact with the system to deliver sufficient comfort. Again, because the shape of the foot does not conform to the surface of the steepened shank in higher heels, the ball of the foot tends to rest far forward of the axis of the intended ball break. The higher the heel height, the farther forward the ball of foot migrates to approach the toes, creating a substantial distance between the intended ball break and the actual ball break. The distance between the actual ball and the intended ball break suggests the span of the footbed surface that is not fully supporting the foot.

A few prior art systems have been proposed to increase wearer comfort or support, but to date no effective system for increasing comfort in high heeled shoes has been discovered.

Hickey, U.S. Pat. No. 4,631,841 discloses an insert for high heeled shoes. Hickey teaches a shoe insert having a forward flatter portion for supporting the forefoot of the wearer and an midfoot area. However, the midfoot area of Hickey has a maximum thickness of about ¼ inch.

Dananberg, U.S. Pat. No. 5,782,015 discloses a high-heel shoe design in which the heel seat has a lesser downward slope than a typical high-heel and the forward portion of the foot bed has a slightly upward rising slope. However, this invention has a fixed shape and, thus, cannot accommodate variability in feet in terms of arch heights, arch locations, and clearance distances, nor can it accommodate the changing shape of the foot of the wearer during gait.

Custom fitted orthotics for diabetic and rheumatoid patients have previously been developed for use in low-heeled shoes. These orthotics are custom shaped using heat moldable materials to maximize foot support and reduce pressures on the bony prominences of the plantar surface of the foot which can cause ulcers. These orthotics are generally constructed from a variety of semi-rigid materials such as EVA or PPT, to accommodate the shape of the foot. Such orthotics are typically full-length devices that are usually accompanied by extra depth at the heel, both of which are unnecessary for the present invention. Furthermore, any ball of foot padding in such orthotics rests at or behind the ball break instead of forward of the ball break where maximum pain is experienced in high heels as described in paragraph 10. The padding in typical orthotics is either in the heel or in the true ball of foot and not in the midfoot. Orthotics tend to have a deeper heel cup and the ball of foot padding does not elevate the foot in the shoe. Although these orthotics have been used in the past, they have been used only with low heeled shoes and cannot be mass produced because the materials are not conformable enough to accommodate a range of foot shapes and positions while providing proper support.

The present invention provides significant advantages over these and other prior art devices.

DETAILED DESCRIPTION

Embodiments of the present disclosure include a shoe, particularly a high-heeled shoe, that contains a convex midfoot support structure formed of a cushioning material. The cushioning material has a sufficient density to support loading by the arch of the foot. The midfoot support structure is sized and shaped to have a height sufficient to contact and to support at least a portion of the midfoot area of the wearer's foot. The midfoot support is constructed of an elastomeric material with a maximum thickness of between 10 mm and 25 mm. The midfoot support includes a support surface and side walls spaced apart from the shoe upper inner walls, but may be adjoined to the shoe upper inner walls. Preferably, a forefoot support is also provided on the upper surface of the insole in the forefoot portion of the insole.

Embodiments of the present disclosure have particular application in midheel and high heel shoes (anything greater than 1 inch [2.54 cm] in heel height) to provide support in the midfoot areas of the shoes. The system reduces plantar pressure and localized stress in the foot in footwear overall.

Figure 2:
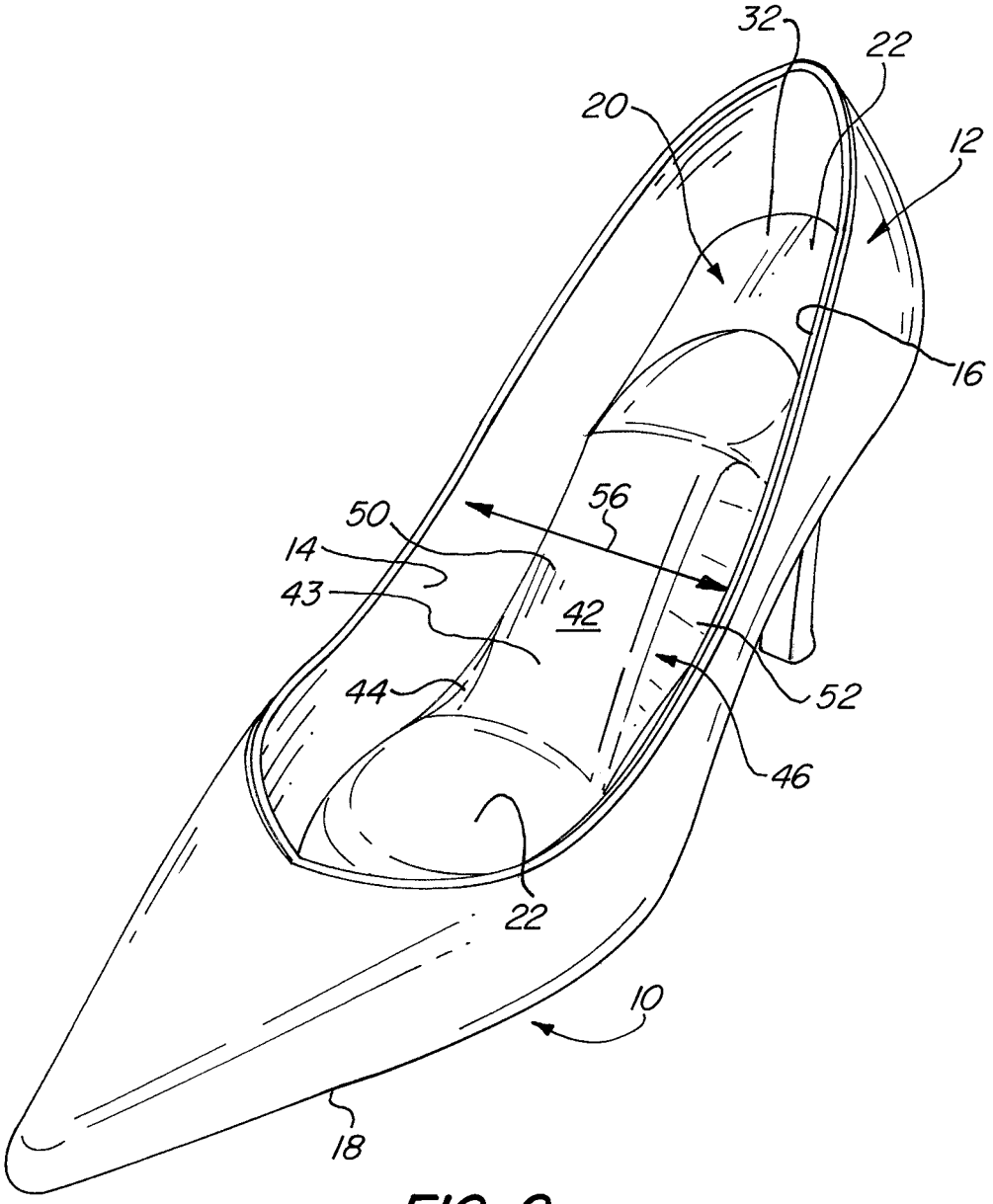
FIG. 2 shows a perspective assembled view of a high heeled shoe (closed back style) and midfoot support structure in accordance with the invention.

The present invention comprises a compressible and/or conformable insole with midfoot support structure for use in mid- and high-heeled shoes that protrudes from the foot bed of a shoe to support the midfoot and re-distribute the load, mainly borne by the forepart of the metatarsals and toes, across the entire foot. The present invention is preferably embodied in a closed back high-heeled shoe such as the pump shown in FIG. 2, however, it is also applicable in an open back shoe such as the slide shown in FIG. 3 or other shoe styles.

Figure 3:
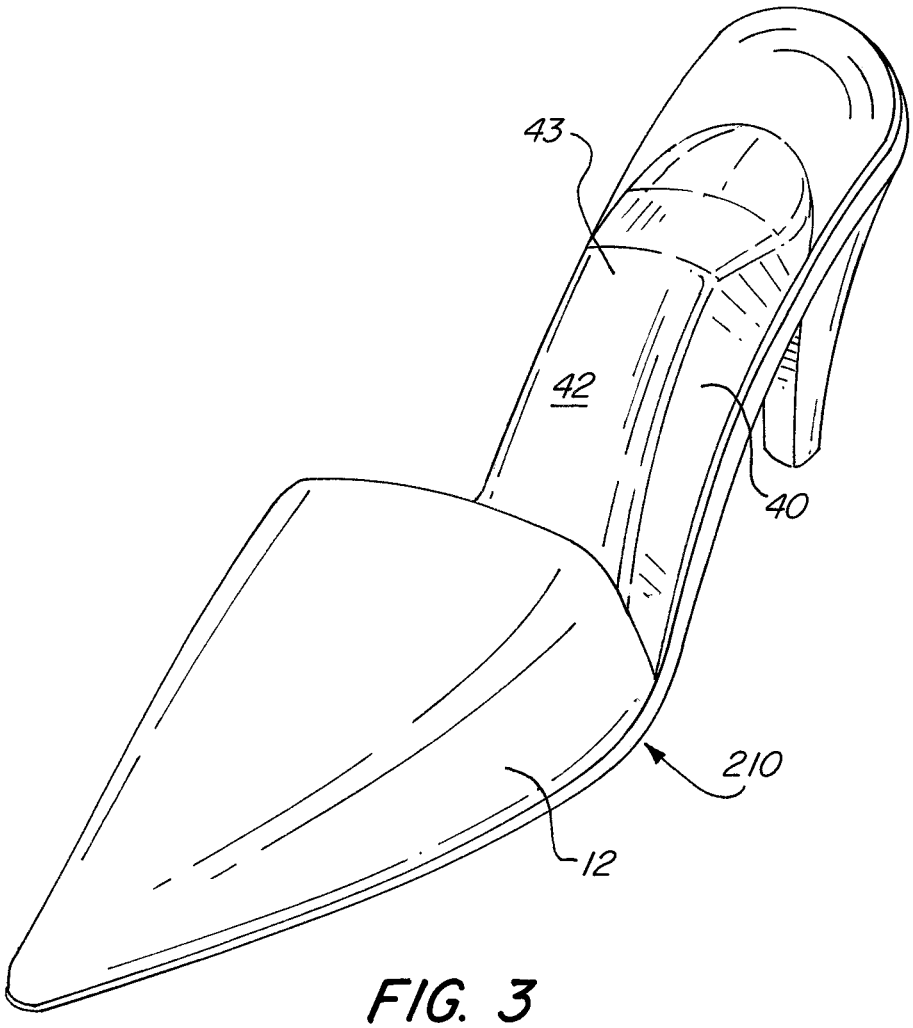
FIG. 3 shows a perspective assembled view of a high heeled shoe (open back style) and midfoot support structure in accordance with the invention.

Referring now to FIGS. 1-5, a shoe 10 is shown in FIGS. 1-2 and 4-5; and a sandal or slide 210 is shown in FIG. 3. Shoes 10 and 210 are essentially similar in construction and elements except for differences in the shoe upper 12. Shoe 10 includes an upper 12 having inner walls 14 and 16. Shoe 10 has an outsole 18 which optionally includes a shank. Shoe 10 has an insole 20 having an upper surface 22 and a lower surface 24. Insole 20 has a toe portion 26 for receiving the toe areas 112 of a wearer's foot 110, a forefoot portion 28 for receiving a ball or metatarsal area 114 of the wearer's foot 110 and a mid-foot portion 30 located in the area of a midfoot area 116 of the wearer's foot 110, and a heel portion 32 located in the area of an heel area 118 of the wearer's foot 110.

A midfoot support structure 40 is located on the upper surface 22 of the insole 20 along the mid-foot portion 30 of the insole 20. The positioning of this support device provides a significant advantage over the prior art. In the preferred embodiment of the invention, the midfoot support structure 40 is placed behind the metatarsal heads of the forward portion of the foot and terminates before the heel. In other words, the midfoot support structure is placed under the midfoot area 116 along the angled shank of the shoe. The midfoot support structure 40 serves both a midfoot support function and a cushioning function.

Figure 5:
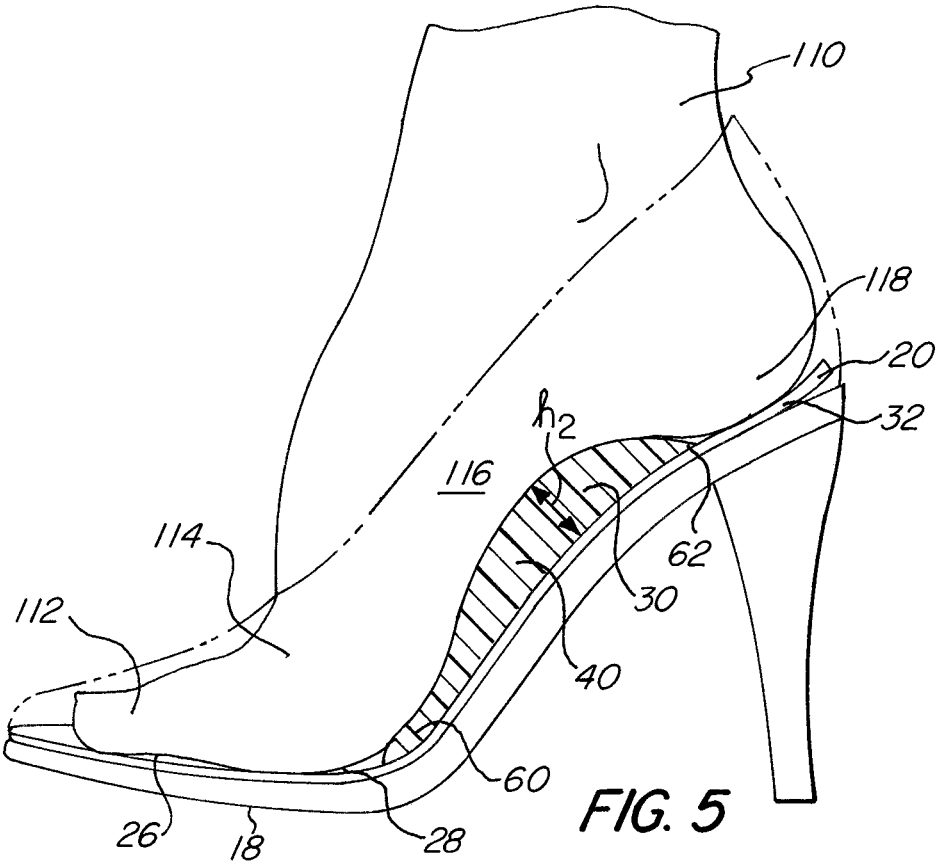
FIG. 5 shows a side view in partial cross-section showing a wearer's foot in a high heeled shoe and midfoot support structure in accordance with the invention with the midfoot support structure under compression.

As best seen in FIG. 5, the midfoot support structure 40 has a convex shape and is sized and shaped to have a height sufficient to contact and to support at least a portion of the midfoot area 116 of the wearer's foot. The midfoot support structure has a front edge 60 and a back edge 62. The midfoot support structure 40 is most preferably located on the upper surface 22 of the insole with the front edge 60 of the midfoot support structure 40 located rearwardly of the toe portion 26 and the back edge 62 of the midfoot support structure 40 terminating forwardly of the heel portions 32 of the insole 20.

Figure 4:
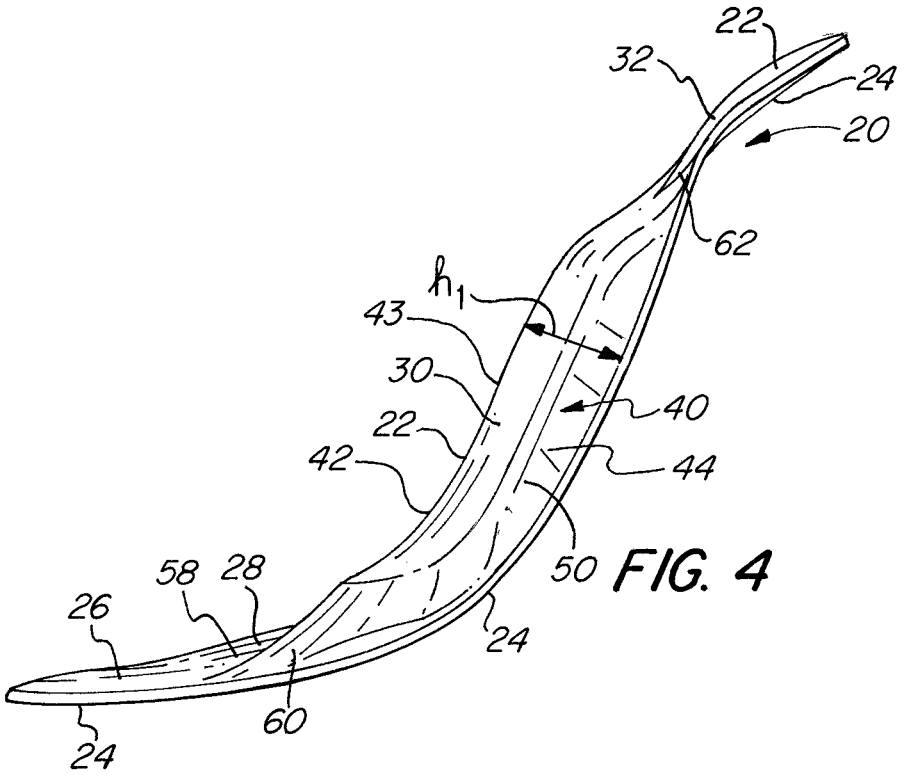
FIG. 4 is a side elevation view of a midfoot support structure in accordance with the invention.

The midfoot support structure 40 is formed of a conformable or compressible cushioning material and preferably has a maximum height h.sub.1 (as seen in FIG. 4) along a central axis that is greater than a maximum midfoot height h.sub.2 of the wearer (as seen in FIG. 5).

The midfoot support structure 40 has a maximum thickness of at least 5 mm. More preferably, it has a maximum thickness of at least 8 mm; or at least 10 mm; even more preferably, it has a maximum thickness of at least 12 mm; or at least 14 mm; or at least 15 mm or at least 16 mm; most preferably, it has a maximum thickness of at least 18 mm; or at least 20 mm; or at least 22 mm; or at least 24 mm; or at least 25 mm. The preferred range of thickness of the midfoot support structure 40 is a maximum thickness of 18 mm to 22 mm in a 100 mm (95 mm to 105 mm) high heel. In one embodiment, the midfoot support structure 40 has a maximum thickness of 16 mm to 20 mm in a 80 to 95 mm high heel. In another embodiment, the midfoot support structure 40 has a maximum thickness of 14 mm to 18 mm in a 65 to 80 mm heel. In yet another embodiment, the midfoot support structure 40 has a maximum thickness of 12 mm to 16 mm in a 50 mm to 75 mm high heel, or may have a maximum thickness of 10 mm to 14 mm in a 40 mm to 65 mm high heel.

The midfoot support structure 40 is preferably incorporated together with the insole 20. In such case, the midfoot support structure 40 may be either made integrally with the insole of the high-heeled shoe, or alternatively may be a separate piece which is glued to or otherwise attached to the insole 20, and in either case will be covered with a sock liner 43 as shown in FIGS. 1-8. Generally, the overall profile of the midfoot support structure 40 with covering sock liner 43 is tapered so as to allow a seamless fit of the midfoot support structure with the shoe.

In one embodiment the profile of the midfoot support structure 40 is preferably flat on the bottom so as to adjoin to the foot bed surface smoothly and contoured to the shape of the foot along the top. In another embodiment the midfoot support structure is made in the form of a wedge. In another embodiment, the wedge midfoot support structure is also tapered along the sides of the front to seamlessly accommodate the foot below the upper vamp of the shoe so as not to cause unnatural upward displacement of the foot in the shoe. In yet another embodiment, the midfoot support structure part 40 is segmented into two or more parts.

Less preferable embodiments include a midfoot support structure 40 which is glued or otherwise attached over the top of a sock liner; and a separate shoe insert. The midfoot support structure 40 is preferably covered with an appropriate sock liner material although in some embodiments the sock liner may be omitted. In shoes where there is no insole or the insole is flexible or soft in nature, the midfoot support structure 40 may be formed into or affixed to the top inner surface of the outsole (i.e., the side not touching the ground). The midfoot support structure 40 may also be located between an insole and outsole.

The midfoot support structure 40 is preferably contoured to have a maximum thickness in the arch area of the foot on the inner side of the foot. In the preferred embodiment, the midfoot support structure 40 has an inside side edge 50 and an outside side edge 52, and the inside side edge 50 has a greater thickness than the outside side edge 52. In one such preferred embodiment, the insole 20 has a thickness of at least 2 mm, and (a) the midfoot support structure 40 inside side edge 50 has a thickness of at least 12 mm and the midfoot support structure outside side edge 52 has a thickness of at least 4 mm; or (b) the midfoot support structure 40 inside side edge 50 has a thickness of at least 16 mm and the midfoot support structure outside side edge 52 has a thickness of at least 6 mm; or (c) the midfoot support structure 40 inside side edge 50 has a thickness of at least 20 mm and the midfoot support structure outside side edge 52 has a thickness of at least 8 mm. The contour of the midfoot support structure 40 provides a rounded pivot is created at the center of the wearer's foot 110 which works to transfer the load distribution on the foot in the same way as a seesaw, because the heavier side of the foot at the heel is now working to counterbalance loading on the lower side of the foot at the ball. Thus, load distribution is more evenly distributed along the foot 110. The heel sits level on the extended heel seat, which provides support for the foot. The midfoot support structure 40 is more than just cushioning. The rounded pivot provided by the midfoot support structure 40 requires substantially greater thickness than prior art devices such as orthotics in order to provide both a support that provides a total footbed contact with the foot as well as load transfer.

The midfoot support structure 40 has a support platform 42, extending along a central axis of the midfoot support structure 40, and sidewalls 44 and 46 extending from the support platform 42 to the insole 20. In the preferred embodiments of the invention, the support platform 42 and sidewalls 44 and 46 of the midfoot support structure are located within and spaced apart from the inner walls 14 and 16 of the upper 12. Preferably, the sidewall 44 of the midfoot support structure 40 at the inside side edge of the midfoot support 40 extends from the insole 20 upwardly and laterally away from the inner wall 14 and insole 20 at an acute angle from vertical. Most preferably, the sidewall 44 of the midfoot support structure 40 at the inside side edge of the midfoot support 40 extends from the insole 20 upwardly and laterally away from the inner wall 14 and insole 20 at an angle of up to 45 degrees from vertical.

The upper 12, outsole 18, or insole 20 have a maximum width area 56 having a width which is the maximum shoe width. In most embodiments, the support platform 42 of the midfoot support structure 40 has a width which is equal to or less than the width of the maximum width area. This embodiment will be particularly useful for sandal/mule embodiments as in FIG. 3, as the midfoot support structure 40 will be less obvious or pronounced when the shoe is being worn.

In some embodiments, the midfoot support structure 40 has a support platform 42 which has a width which is greater than the width of the insole 20.

In one desirable embodiment, the midfoot support structure 40 has a lower portion 48 positioned to apply lateral pressure to a lower part of the inner walls 16 and 18 of the upper 12 sufficient to move one or both of the upper edges 17 and 19 of the inner walls 16 and 18 to a closer proximity to the wearer's foot 110 than would occur in the absence of such lower portion 48.

In preferred embodiments of the invention, the midfoot support structure includes a forefoot support 58 located on the upper surface of the insole 20 in the forefoot portion 28 of the insole 20. The forefoot support 58 has a thickness of at least 4 mm and is located on the upper surface of the insole in the forefoot portion 28 of the insole 20.

Figures 6, 7, 8:
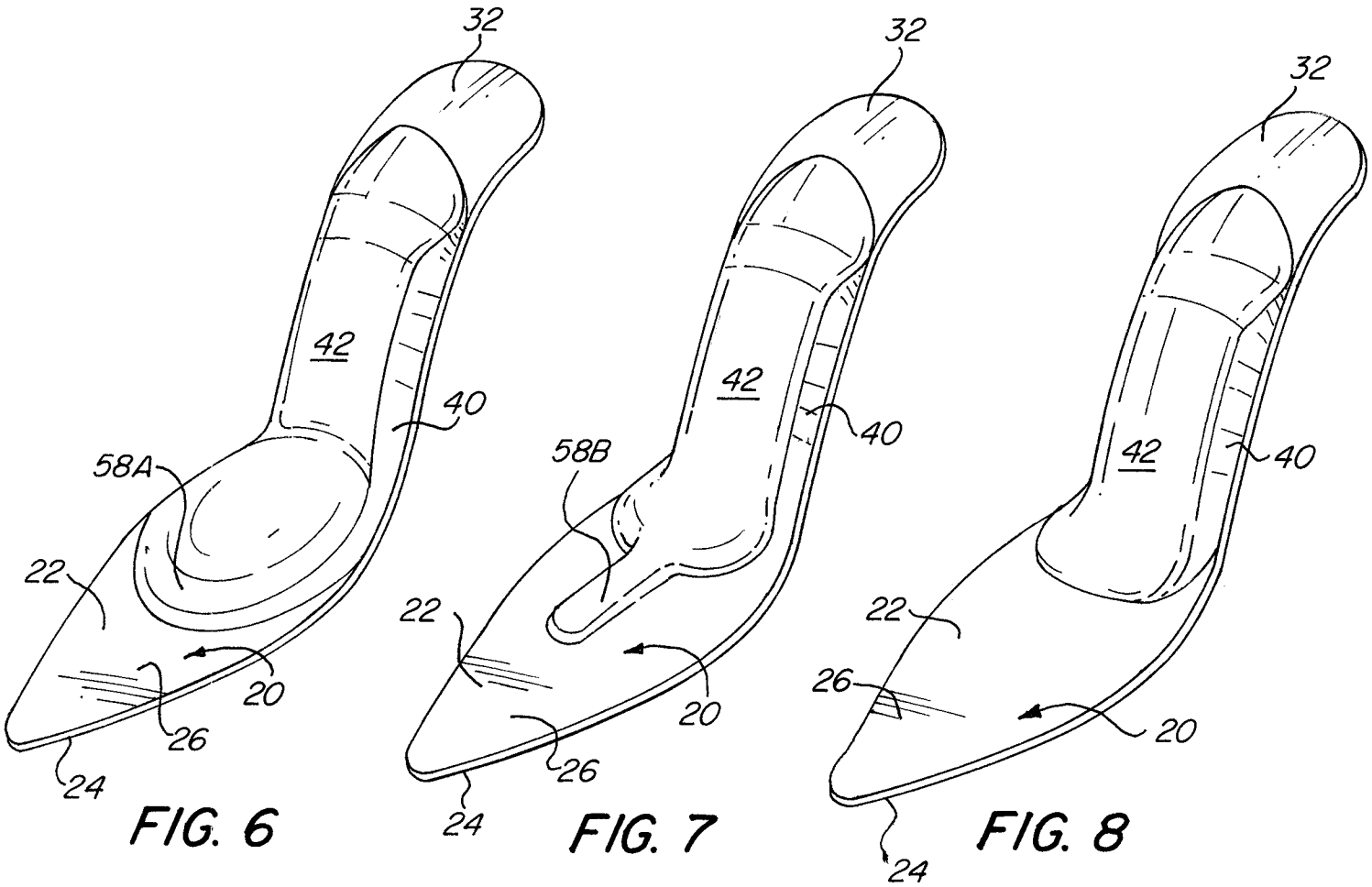
FIG. 6 is a perspective view of a first embodiment of a midfoot support structure with a forefoot support structure in accordance with the invention.
FIG. 7 is a perspective view of a second embodiment of a midfoot support structure with a forefoot support structure in accordance with the invention.
FIG. 8 is a perspective view of a third embodiment of a midfoot support structure in accordance with the invention.

A forefoot support 58A may span the width of the shoe as seen at in FIG. 6. The more material that is used in the forefoot, the greater the likelihood of adjustments to the shoe last and the corresponding upper to accommodate the displacement of the foot by the material. The preferred mode, therefore, is the more localized approach of FIG. 7, where the forefoot support 58B is a central finger of material located in the area of a wearer's second and third metatarsals. The forefoot support 58B prevents tightness of the vamp against the upper part of the foot during wear and lessens the need for an exaggerated last and corresponding upper. In an alternate embodiment, the forefoot support 58A may include an open cavity located in at least the area of a wearer's second and third metatarsals. In an alternative embodiment, the finger shaped forefoot support 58B may be an open cavity in the surface of the insole 20 which is surrounded by a thicker cushion material. In a most preferred embodiment, the forefoot portion 28 of the insole 20 has a cavity containing a forefoot support 58B which is a finger of a conformable or compressible cushioning material, such as a polyurethane memory foam. This embodiment provides a generally flush upper surface with a high degree of comfort.

The forefoot support 58 may be omitted entirely, as shown in FIG. 8. However, use of at least some forefoot cushioning is recommended to optimize and sustain overall performance. The elevation of the forefoot cushioning also serves to level out the foot inside of the shoe to further balance loading to the rearfoot and midfoot. Localized support is most critical in the forefoot as this is the most snug-fitting area of the shoe.

The heel area 32 should remain relatively flat and minimally cushioned to enable sufficient lodging of the heel in place behind the midfoot support structure 40. The system works with no cushioning material in the heel or with a thin cushion material. Generally, 2 mm to 4 mm is preferred by wearers. If the cushioning in the heel is too thick in a high heeled shoe, the foot has the tendency to slide forward. In a closed heel or flat shoe execution, additional material might line all or a portion the perimeter of the footbed to provide enhanced stabilization and cushioning. The heel area 32 is distinguished from the midfoot area by either an abrupt or gradual incline.

The midfoot support structure 40 has the effect on the wearer of transferring both static load (when the wearer is standing still) and transient impact loads (when the wearer is walking) from the wearer's ball area 114 and heel area 118 of the wearer's foot 110 to the midfoot area 116 of the wearer's foot 110. This transfer and redistribution of load increases wearer comfort. In prototype testing, test subjects reported a significant increase in comfort. The sensations reported by test subjects include solid support by the soft mound of the midfoot support structure 40 and the impression of standing in a considerably lower-heeled shoe. The reduced load on the wearer's ball area 114 in the forefoot is occurs because the midfoot support structure 40 operates as both a support for midfoot area 116 of the wearer's foot 110 and as a pivot on which the wearer is able, by different positioning of their foot, ankle, leg and body positions, to change the distribution of load on the different parts of the foot. Thus, the wearer can transfer weight away from the ball of the foot to the heel area by standing more firmly in the heel, transferring her weight from the ball area 114 to the heel area 118. However, this is not a fixed weight distribution, as the wearer actively and continuously adjusts load distribution on the foot. This ability of the wearer to actively manage to load distribution on the foot is one more feature of the invention that provides wearer comfort unlike that of prior art systems.

It has been discovered that the present invention is so effective at transferring loads to the midfoot area 116 of the wearer's foot 110 that the wearer's heel area 118 does not display the same degree of lateral expansion as is typical in shoes lacking the midfoot support structure 40. In other words, in a high heeled shoe lacking the midfoot support structure 40, the heel area 118 of the wearer's foot will exhibit lateral spreading due to the load of the wearer's weight on the heel area causing the heel tissues to flatten and spread out laterally. The inclusion of the midfoot support structure 40 reduces this effect. It has been found that the midfoot support structure 40 supports the wearer's foot sufficiently such that that lateral displacement of the wearer's heel is reduced by 2 mm to 8 mm relative to a shoe lacking such midfoot support structure. To provide a proper fit in a shoe including the midfoot support structure 40, the upper 12 should have a narrower heel volume than a standard shoe of the same size. In a preferred embodiment, the upper 12 has a heel volume which is 2 mm-8 mm narrower than the heel volume of a standard shoe of the same size. In addition, in some embodiments, the shoe outsole, insole or upper may have a shorter length than a standard shoe of the same size.

Selecting the appropriate materials for this invention is challenging because the material has to be of sufficient strength to support the load placed upon it without bottoming out while at the same time providing a nice contact softness to the foot. The ideal material is conformable or compressible, lightweight, feels good to the wearer, and has high load bearing capacity. Ideally, the material will also conform to the shape of the foot of the wearer and rebound quickly enough to reset its load bearing strength for sustained wear. The material may also offer energy return.

The midfoot support structure 40 is formed of a material which is preferably of sufficient density to support loading by the midfoot and the forefoot without full compression so as to avoid bottoming out of the midfoot, while also being supple enough to be comfortable for the wearer. The material will preferably have sufficient molding capability to adapt to the changing shape of the foot of the wearer during gait. The midfoot support structure 40 is intended to give under the weight of the wearer so as to conform to the specific shape of the wearer's foot at all phases of gait while being sturdy enough under such load to provide sufficient support without bottoming out. Examples of materials that would readily serve this purpose include substantially dense regular foams, memory foams and other slow rebound materials, EVA, latex, rubber, polyurethane and other viscoelastic materials, silicone, gels, soft solids, soft plastics, water and other liquids, air and tiny particles like sand, beads, and seeds contained within sturdy, yet flexible membranes. Such systems are dual-purpose systems intended to provide both firm support in areas of interest and cushioning for further comfort. To make the material more compliant during compression, firmer materials might be grooved, channeled, cored, etc. (i.e, material removed from top to bottom) to yield a softer feel. To make the materials more supportive during compression, gels, soft solids, or soft composites might be infused with stiff fibers to add strength. Materials that generally hold to the shape of the impression of the foot under loading for extended periods of time while providing comfort, pressure relief, energy return, shock absorption, and/or impact absorption while standing or walking are fine. The midfoot support structure 40 is preferably formed of a conformable or compressible cushioning material, which is preferably an elastomeric material such as an open cell viscoelastic material, a close cell viscoelastic material, or a noncellular viscoelastic material. The conformable or compressible cushioning material being an unsaturated rubber, a saturated rubber, or another elastomer. Unsaturated rubbers may include natural rubber, synthetic polyisoprene, butyl rubber, halogenated butyl rubbers, polybutadiene, styrene-butadiene rubber, nitrile rubber, hydrogenated nitrile rubbers, chloroprene or neoprene rubber. Saturated rubbers may include ethylene propylene rubbers and ethylene propylene diene rubber, polyacrylic rubber, silicone rubber, ethylene vinyl acetate, and polyurethane.

One desirable material for use in the invention is a polyurethane memory foam. Polyurethane memory foam is made from polyurethane with additional chemicals that add to its viscosity level, thereby increasing its density. It is often referred to as visco-elastic polyurethane foam. Depending on the chemicals used and its overall density, it is firmer in cooler temperatures and softer in warmer environments. Higher density memory foam reacts to body heat which allows it to mould itself to the shape of a warm body within a few minutes. A lower density memory foam is pressure-sensitive and will mold more quickly to the shape of the body.

The hardness or softness of the material is important to the present invention. Material hardness is determined by an Indentation Force Deflection (IFD) or Compression Force deflection (CFD) rating. CFD measures the amount of force, in pounds, required to compress a 2"×2"×1" sample by 25%. This is commonly known as CFD @ 25% compression. Preferably, the midfoot support structure 40 is made from a material having a CFD of 0.6 psi to 30 psi at 25% compression on the uppermost surface that comes in contact with the foot.

In the preferred embodiment, the midfoot support structure 40 is a foam or non-foam polyurethane.

It would be ideal to have a single material that was comfortable enough to serve as cushioning, yet strong enough to resist flattening or feeling hard when subject to impact. However, most materials are either soft with insufficient compression strength under heavier loads, or firm enough to support high loading, but feel hard to the plantar surface of the foot. In other words, the greater the compression strength, the harder the material. With these limitations, a preferred embodiment of the midfoot support structure 40 is provided with layers of materials where each layer plays a different role. In the preferred construction, an upper, thicker layer is the contact layer that signals comfort and softness to the wearer while a lower, thinner layer is a support layer that provides longer-term support and prevents bottoming out.

The support layer can be restricted to the front of the insole, the area where pressure is typically the greatest in high heels. Or the support layer can extend to a greater portion of the insole to the entire surface of the insole. In one embodiment of the insole, the support layer is thickest in the ball of foot region at about 6 mm, and thins out as it approaches the back of the shoe, providing 2 mm of cushioning support in the heel area. The same layer thins to essentially zero in the forefoot and along the sides in the metatarsal area where the shoe is most snug fitting to maximize comfort in the forefoot while minimizing tightness of the shoe. In another embodiment, there is more than one support layer. For example, one support area in the heel, another support area in the forefoot. Both may be of the same or different material, the same or different densities. Or one support layer may rest beneath another support layer. As a typical U.S. Women's Size 8 insole is roughly ¾" in maximum thickness, it is possible to have several layers of material, each with different properties, each offering a different benefit to the wearer. One layer might offer contact softness, another customized contouring, another energy return, another might offer firm support, another might offer firmer support, and so on and so on. As another example, firm materials will be restricted to the forefoot while a soft gel membrane might be in the midfoot and forefoot. The composition may vary along the length, along the width, or along the height or along the length and width or along the length and height, or along the width and height, or along the length, width and height.

Figure 9A:
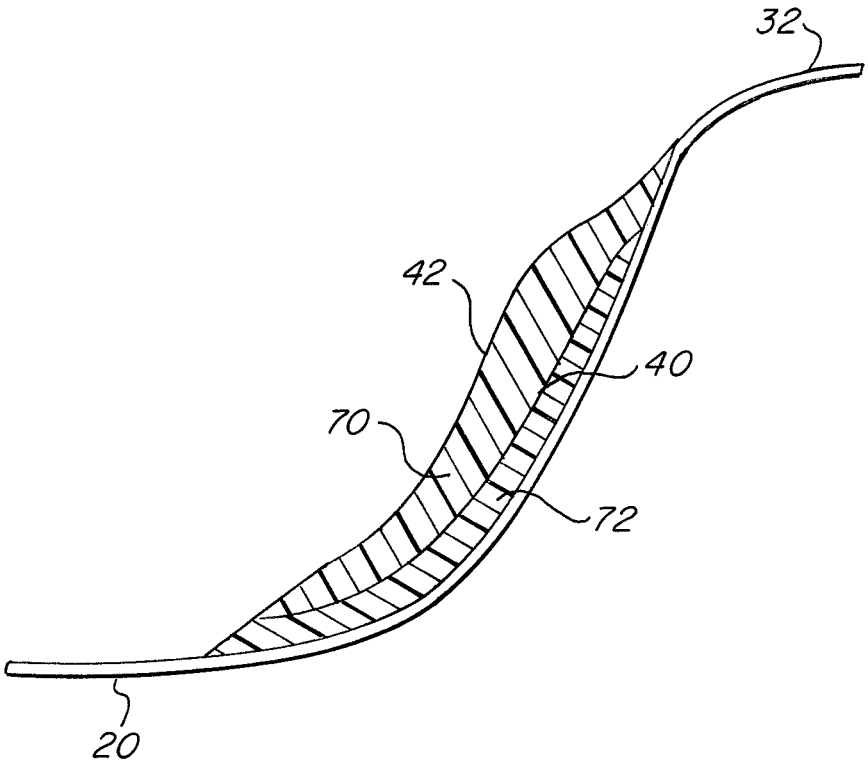
FIG. 9A is a cross-sectional view of a two layer midfoot support structure in accordance with the invention.
Figure 9B:
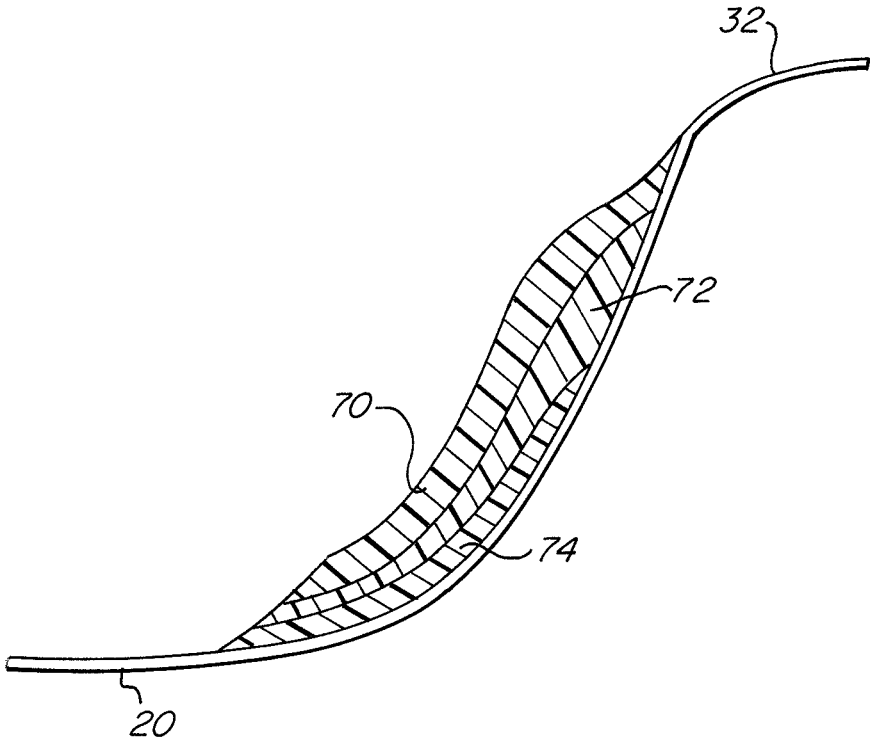
FIG. 9B is a cross-sectional view of a three layer midfoot support structure in accordance with the invention.

In the embodiment seen in FIGS. 9A and 9B, the midfoot support structure 40 comprises at least two layers of materials of varying density, and preferably includes including an upper conformable or compressible cushioning material and a lower energy return material. For example, in FIG. 9A, the top layer 70 is a conforming layer that comes in contact with the foot, the middle layer 72 has a higher density to provide energy return. In FIG. 9B, the top layer 70 is a conforming layer that comes in contact with the foot, the middle layer 72 has a higher density to provide energy return, and the lower layer 74 is has the greatest density to prevent bottoming out of the foot.

In layered versions or versions with multiple compositions, a portion of the present invention might reside in a different layer of the shoe than other portions. For example, the firmer support layer might be placed beneath the insole while the softer, conforming layer might rest atop the insole. It is also wholly possible for any firmer support layers to comprise the outsole.

Figure 1:
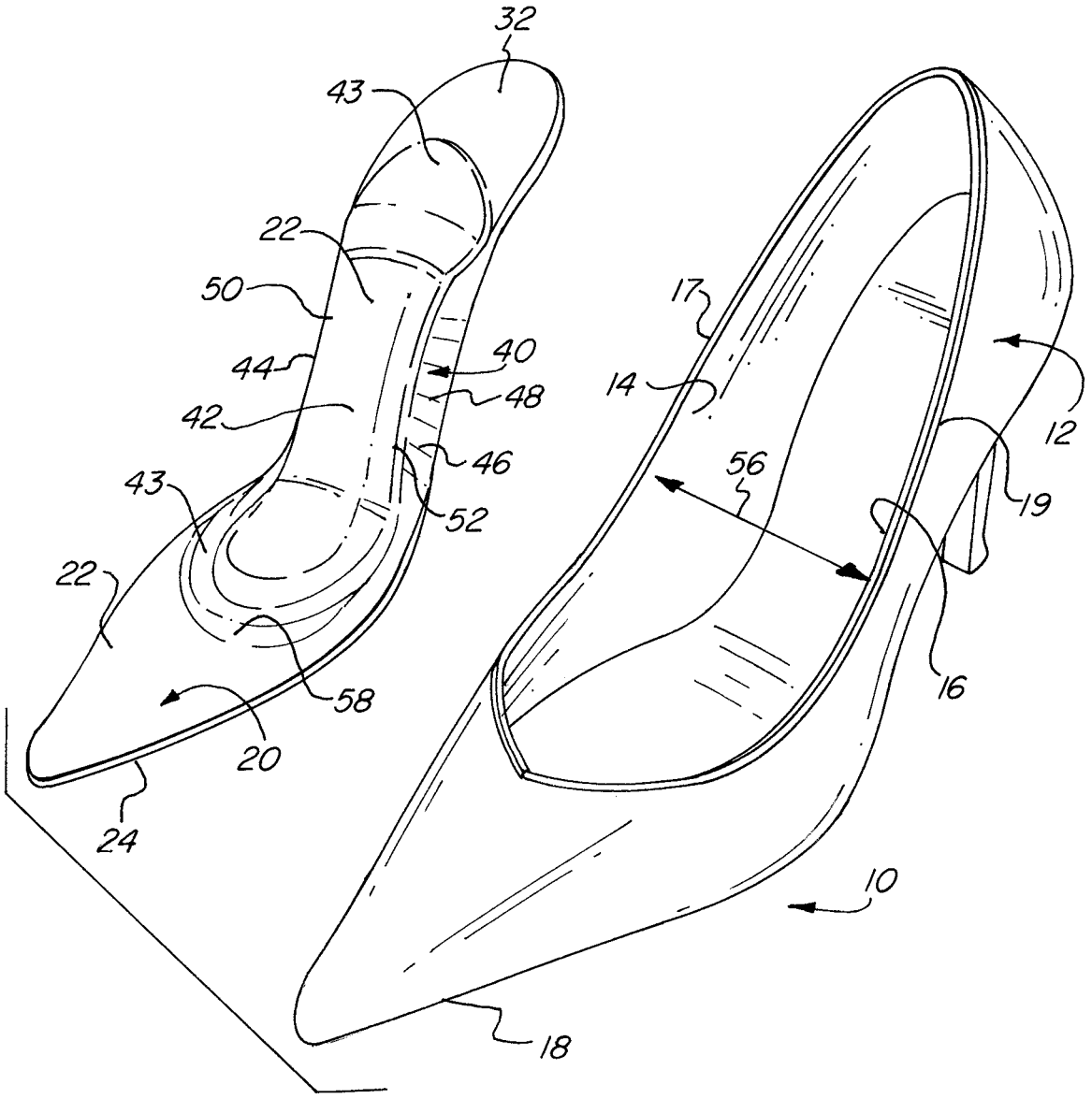
FIG. 1 shows a perspective exploded view of a high heeled shoe (closed back style) and midfoot support structure in accordance with the invention.

A preferred embodiment, shown in FIGS. 1 and 9A, is a dual-layered insole and midfoot support structure 40. The upper, body contouring layer is a memory polyurethane spanning the entire heel at about 2 mm thickness, the entire midfoot area at about 20 mm maximum thickness on the inside side and 8 mm on the outside side, and only a portion of the forefoot area just at the second and third metatarsals at 4 mm. The bottom layer is a standard polyurethane foam with energy return properties that starts at the intended ball break and spans the full forefoot. The bottom layer is thickest in the ball of foot region only at 5-6 mm and thins out along the side areas in the toe area to ensure proper fit of the shoe. This version was specifically designed for a closed toe pump.

The contact area of the foot to the footbed is directly correlated to the distribution of pressure on the foot. In testing conducted in connection with the invention comparing conventional flat shoes with conventional 100 mm high heeled shoes with 100 mm high heeled shoes using a midfoot support structure in accordance with the invention, it was discovered that the contact area of the foot in 100 mm high heeled shoes using a midfoot support structure in accordance with the invention is in the range of 93-105% of the contact area of the foot in a flat shoe, but that the contact area of the foot in a conventional 100 mm high heel is in the range of 65-80% of the contact area of the foot in a flat shoe. The peak pressures in 100 mm high heeled shoes using a midfoot support structure are reduced by as much as two-thirds in the ball area of the user's foot relative to a conventional 100 mm heel.

The invention is applicable across a range of body weights and various foot sizes and styles of footwear. Increasing the surface area that actually comes in contact with the foot is highly effective in balancing loading on the metatarsals and provides pressure relief. The increase in surface contact implemented through the correct shape, form, and material provides the benefits of personalized fit, optimized heel stabilization and support, arch support, ball of foot support, cushioning; and energy return.

The midfoot support structure 40 is generally level with or even higher than the heel portion 32 of the shoe and therefore elevates and supports the midfoot area 116 of the wearer's foot so that the foot is sufficiently flattened to bear its due load. The midfoot support structure 40 moves weight rearwardly to the heel area 118 in addition to supporting load in the midfoot area 116.

It is also possible for the present invention to be stylized according to designers' preferences, which may involve sectioning the invention, streamlining the invention, or even exaggerating some components of the invention. These alterations are generally meant to cater to style preferences and trends while the spirit of the invention remains. In some cases, designers may be willing to forego some performance effectiveness to achieve a certain style benefit that may be limited with the full present invention. This might mean that only a portion of the optimal area is elevated while the spirit of the invention remains. For example, the height of the midfoot section may be reduced in a mule or sandal.

The present invention is sophisticated in function providing grounding in the heel (lodging it in place to prevent sliding), midfoot support, forefoot cushioning, balanced pressure distribution, and/or leveling of the foot in the shoe, the invention is lightweight in construction and simple in appearance. While inspired by the unique needs of high heels, the present invention also has application for flat shoes (mens, womens, and childrens). Flat shoes are level in construction and loading is generally balanced across both the heel and the ball of the foot. However, the foot is still subject to fatigue during excessive periods of standing or walking. Over time, pain first mounts in the heel and then to the ball of the foot in flat shoes. To mitigate this pain, this present invention may be further modified to provide additional heel cushioning and support in addition to the heel stabilization, arch support, and forefoot cushioning already provided.

What is claimed is:

1. An insole for a shoe, comprising:
a toe portion to support toes of a foot;
a forefoot portion to support a ball of the foot;
an inclined heel portion to support a heel of the foot;
an inclined midfoot portion; and
a midfoot support structure, disposed along the midfoot portion, to support a midfoot area of the foot, the midfoot support structure including:
a support platform having a contoured top surface,
a first angled sidewall,
a second angled sidewall,
a front edge disposed rearward of the forefoot portion, and
a back edge disposed forward of the heel portion,
where the midfoot support structure is formed from a cushioning material having a thickness that varies from the front edge to the back edge, and a maximum thickness of at least 10 mm, and
where the cushioning material is configured to form a rounded pivot under compression.

2. The insole of claim 1, where:
the first angled sidewall is angled inward;
the second angled sidewall is angled inward; and
the rounded pivot is configured to transfer a load from the forefoot portion to the heel portion, and from the heel portion to the forefoot portion.

3. The insole of claim 1, where the cushioning material is a conformable or compressible material, and the maximum thickness depends upon a heel height of the shoe including an 18 mm to 22 mm maximum thickness for a 95 mm to 105 mm heel height, a 16 mm to 20 mm maximum thickness for an 80 mm to 95 mm heel height, a 14 mm to 18 mm maximum thickness for a 65 mm to 80 mm heel height, a 12 mm to 16 mm maximum thickness for a 50 mm to 75 mm heel height, and a 10 mm to 14 mm maximum thickness for a 40 mm to 65 mm heel height.

4. The insole of claim 3, where the cushioning material includes an upper layer having a first density and a lower layer having a second density that is greater than the first density.

5. The insole of claim 4, where the upper layer has a Compression Force Deflection (CFD) of 6 psi or more at 25% compression.

6. The insole of claim 3, where the cushioning material includes an upper layer having a first density, a middle layer having a second density that is greater than the first density, and a lower layer having a third density that is greater than the second density.

7. The insole of claim 3, where the cushioning material is selected from the group consisting of open cell viscoelastic foam, closed cell viscoelastic foam, silicone, gel, liquid contained in a flexible membrane, and particles contained within a flexible membrane.

8. The insole of claim 3, where the support platform of the midfoot support structure includes an outside side edge and an inside side edge having a greater thickness than the outside side edge.

9. The insole of claim 3, where the forefoot portion includes additional cushioning material.

10. The insole of claim 9, where the additional cushioning material has a finger shape.

11. A high-heeled shoe, comprising:
an upper;
an outsole, attached to the upper, having an upper surface and a lower surface;
a heel, depending from the lower surface of the outsole, having a height; and
an insole, disposed along at least a portion of the upper surface of the outsole, including:
a toe portion to support toes of the foot;
a forefoot portion to support a ball of the foot;
an inclined heel portion to support a heel of the foot; and
an inclined midfoot portion, and
a midfoot support structure, disposed along the midfoot portion, including:
a support platform having a contoured top surface,
a first angled sidewall,
a second angled sidewall,
a front edge disposed rearward of the forefoot portion, and
a back edge disposed forward of the heel portion,
where the midfoot support structure is formed from a cushioning material having a thickness that varies from a front edge to a back edge, and a maximum thickness of at least 10 mm,
where the cushioning material is configured to form a rounded pivot under compression.

12. The high-heeled shoe of claim 11, where:
the first angled sidewall is angled inward;
the second angled sidewall is angled inward; and
the rounded pivot is configured to transfer a load from the forefoot portion to the heel portion, and from the heel portion to the forefoot portion.

13. The high-heeled shoe of claim 11, where the cushioning material is a conformable or compressible material, and the maximum thickness depends upon the heel height including an 18 mm to 22 mm maximum thickness for a 95 mm to 105 mm heel height, a 16 mm to 20 mm maximum thickness for an 80 mm to 95 mm heel height, a 14 mm to 18 mm maximum thickness for a 65 mm to 80 mm heel height, a 12 mm to 16 mm maximum thickness for a 50 mm to 75 mm heel height, and a 10 mm to 14 mm maximum thickness for a 40 mm to 65 mm heel height.

14. The high-heeled shoe of claim 13, where the cushioning material includes an upper layer having a first density and a lower layer having a second density that is greater than the first density.

15. The high-heeled shoe of claim 14, where the upper layer has a Compression Force Deflection (CFD) of 6 psi or more at 25% compression.

16. The high-heeled shoe of claim 13, where the cushioning material includes an upper layer having a first density, a middle layer having a second density that is greater than the first density, and a lower layer having a third density that is greater than the second density.

17. The high-heeled shoe of claim 13, where the cushioning material is selected from the group consisting of open cell viscoelastic foam, closed cell viscoelastic foam, silicone, gel, liquid contained in a flexible membrane, and particles contained within a flexible membrane.

18. The high-heeled shoe of claim 13, where the support platform of the midfoot support structure includes an outside side edge and an inside side edge having a greater thickness than the outside side edge.

19. The high-heeled shoe of claim 13, where the forefoot portion includes additional cushioning material that has a finger shape.

20. The high-heeled shoe of claim 11, where the upper includes:

a toe box, a left wall, a right wall, a heel counter and a topline defining an opening to receive a foot; or a toe box defining an opening to receive a foot.

* * * * *